XR 4,057,791 0/571 X340/566 X340/691 X340/692

United Sta

Bimmerle et al.

[11] 4,057,791

[45] Nov. 8, 1977

[54] MOTION RESPONSIVE ALARM SYSTEM

[76] Inventors: Charles F. Bimmerle, 4399 Foley Road, Cincinnati, Ohio 45238; James R. Braig, 3235 McGill Lane, Cincinnati, Ohio 45239; Ivars J. Vilums, 2322 Kline Ave., Cincinnati, Ohio 45211

[21] Appl. No.: 656,161

[22] Filed: Feb. 9, 1976

[51] Int. Cl.[2] ..... G08B 13/14

[52] U.S. Cl. ..... 340/261; 200/61.47; 73/654; 340/280

[58] Field of Search ..... 340/261, 65, 280, 52 H; 200/61.47, 61.45 R; 73/71.2, 71.4

[56] References Cited

U.S. PATENT DOCUMENTS

| | | | |
|---|---|---|---|
| 3,129,347 | 4/1964 | Tognola | 73/71.2 |
| 3,677,077 | 7/1972 | Merryman et al. | 73/71.2 |
| 3,745,815 | 7/1973 | Bentone et al. | 73/71.4 |
| 3,962,696 | 6/1976 | Smith et al. | 340/261 |

*Primary Examiner*—Glen R. Swann, III

*Attorney, Agent, or Firm*—Melville, Strasser, Foster & Hoffman

[57] ABSTRACT

The alarm system, which may be fastened to an object whose movement is to be monitored, includes a unique sensor array providing no output in any static orientation and a pulsating output in response to motional disturbances. A latch circuit is connected to the sensor array and develops a logically high output in response to a pulse from the sensor array. The output of the latch circuit remains logically high until the sensor array fails to output a pulse for a first predetermined time. A triggering circuit generates a trigger signal for activating a series of alarm functions after the latch circuit output has been continuously logically high for a number of the first predetermined time periods. Also, an alarm function may be connected to the latch circuit so as to activate whenever the latch output is logically high.

10 Claims, 5 Drawing Figures

A

B

MOTION RESPONSIVE ALARM SYSTEM

BACKGROUND OF THE INVENTION

This invention relates generally to alarm systems and more particularly to an alarm system for detecting motional disturbances of objects desired to be maintained in a stationary state.

There currently exists a need for a motion responsive alarm system which can be utilized in a variety of applications ranging, for example, from outdoor use to protect unattended vehicles and a variety of non-vehicular property such as construction materials and the like to indoor use in connection with numerous items such as vending machines and the like. In either event, system requirements include a sensor package providing motion detection sensitivity to cover all space in three dimensions and preferably a sensor package mountable in any orientation without requiring adjustment, a circuit design for processing the sensor output in a manner so as to reliably distinguish between minimal movements of an acceptable nature and movements of a more aggravated type and a signal unit adaptable to the particular property/items being monitored and capable of providing both visual and audible alarm indications.

In addition, the circuit design should be of a type which dissipates minimal energy when in the armed mode yet remains active and capable of processing sensor output data. The latter characteristics are highly desirable in the case of portable alarm systems of the type contemplated by the present invention, where extended use in various environments may be required.

Various systems have heretofore been provided for detecting motional disturbances of normally stationary objects such as unattended vehicles and the like. These systems are normally directly attached to the monitored vehicle and employ various sensor and circuitry arrangements to detect unauthorized movements. Typically, due to the design of the sensor arrays utilized, the prior art units must be affixed to the vehicle in a particular spatial orientation or, when a multi-positional device is employed, certain adjustments must be made to properly initialize the unit. Furthermore, although the prior art sensor arrays generally exhibit adequate sensitivity to motion in a particular direction, they do not provide sufficient detection sensitivity to motion in other directions. These deficiencies limit the operational usefulness of prior art systems at the point of basic criticality in an alarm system, the sensing function.

Prior art attempts to provide means for distinguishing between relative levels of motional disturbances have likewise not been altogether satisfactory. Counters are frequently employed but this technique fails to account for the relationship between the sensed disturbance and its time duration. The circuitry of prior art systems are further deficient in that they generally are passive when in the armed mode thereby being rendered unable to accomplish their logic function.

SUMMARY OF THE INVENTION

It is in general an object of the present invention to provide a motion responsive alarm system which can be employed in a variety of applications.

More specifically, it is an object of the present invention to provide a motion responsive alarm system which includes sensing means mountable on the property to be protected in any spatial orientation without requiring initializing adjustments. It is a further object of the present invention to provide such sensing means having detection sensitivity to cover all space in three dimensions.

Another specific object of the present invention is to provide an alarm system of the above character which includes means for distinguishing between relative levels of motional disturbances and, in particular, for detecting continuous type disturbances which last for a predetermined length of time. A related object of the invention is to provide a detection circuit which, in its armed mode, draws low current while remaining an actively energized logic circuit.

A final specific object of the present invention is to provide an alarm signaling package providing both visual and audible alarm indications in a highly noticeable form.

In accordance with these and other useful objects, the motion responsive alarm system of the present invention includes a sensor array, mountable on a vehicle or the like in any spatial orientation, for detecting motional disturbances and for producing a pulsating output signal in response thereto. The pulsating output from the sensor array is applied to a resettable monostable multivibrator having a Q output and a $\overline{Q}$ output. The Q output is connected as the source voltage for a UJT relaxation oscillator and the $\overline{Q}$ output is connected to a first input of a NOR gate. The output of the UJT oscillator is connected to the second input of the NOR gate. The output of the NOR gate is connected through a firing circuit to an appropriate series of alarms.

In response to a pulse from the sensor array, the monostable multivibrator, which functions as a latch circuit, changes state whereby the Q output assumes a logically high level and the $\overline{Q}$ output assumes a logically low level. As a consequence, a logically low level signal will be applied to the first input of the NOR gate and the voltage at the emitter terminal of the unijunction transistor of the UJT oscillator will begin rising at a linear rate. The monostable multivibrator will remain in this state until the sensor array fails to output a pulse for a predetermined length of time in which case the monostable will revert to its original state and the voltage at the emitter terminal of the unijunction transistor will discharge. If, however, a series of pulses are generated by the sensor array such that the Q output remains logically high for a number of the predetermined time periods, the conduction point of the unijunction transistor will be achieved. At this conduction point, the unijunction transistor outputs a logically low level signal to the second intput of the NOR gate whereby a logically high level signal is produced at the NOR gate output.

The logically high level signal at the NOR gate output triggers a firing circuit which, in turn, activates a series of alarms. It will be noted that in order to activate the series of alarms the sensor array must output a series of pulses to keep the Q output continuously high for a number of the predetermined periods of time. In this manner, the series of alarms respond only to continuous motional disturbances of a given time duration.

In order to provide multi-directional motion sensitivity, the sensor array includes a first group of motion responsive sensors, the axes of each of which are parallel to a first plane and angularly disposed from each other by a predetermined amount. A second similar group of sensors is provided having axes which lie in a second plane perpendicular to the first plane. By means of this arrangement the sensor array provides motion detection sensitivity to cover all space in three dimensions.

DESCRIPTION OF THE PREFERRED EMBODIMENT

Figure 1:
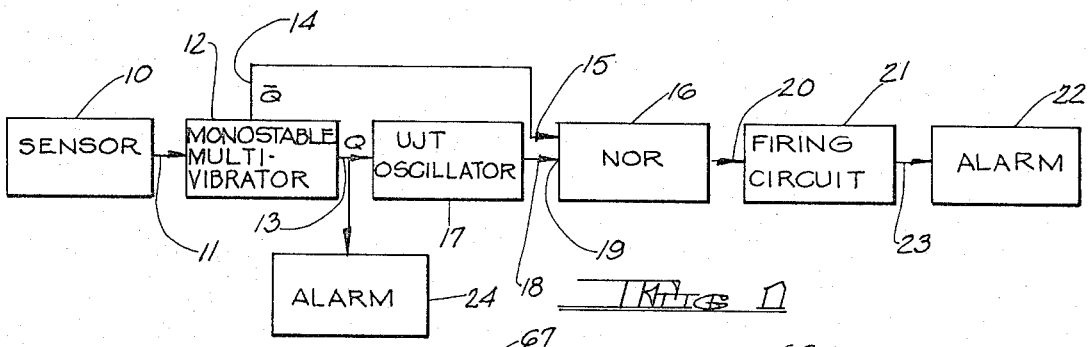
FIG. 1 is a block diagram of the preferred embodiment of the present invention.

Turning now to the drawings, wherein like reference numerals throughout the various views are intended to designate the same or similar elements, FIG. 1 discloses the general arrangement of components of a motion responsive alarm system constructed in accordance with the teachings of the present invention. The alarm system, which may be packaged in a suitable self-contained container, is intended to be directly attached to the item to be protected such as a parked or unattended vehicle. It should be understood, however, that although a vehicle has been referred to, this has been done for exemplary purposes only and that use of the alarm system of the present invention with other items whose motion may be monitored is also contemplated.

With reference to FIG. 1, there is shown a sensor 10 having an output 11 connecting to a monostable multivibrator 12. The sensor 10, which will be described in further detail hereinafter, is one of the type adapted to output pulses in response to motional disturbances thereof. The monostable multivibrator 12, also to be described in further detail hereinafter, includes two outputs, a Q output 13 and a $\overline{Q}$ output 14. As will be understood by those skilled in the art, the $\overline{Q}$ output 14 of monostable multivibrator 12 will always be 180° out of phase with respect to the Q output 13. The Q output 13 of the monostable multivibrator 12, which is normally at a logically low level, transitions to a logically high level in response to a pulse over line 11 from the sensor 10. Simultaneously, the $\overline{Q}$ output 14 will apply a logically low level signal to the first input 15 of a NOR gate 16. The Q output 13 will be latched at the logically high level, and the $\overline{Q}$ output 14 at a logically low level, until the sensor 10 fails to generate an output pulse for a predetermined period of time.

The Q output 13 of the monostable multivibrator 12 connects to a unijunction transistor (UJT) relaxation oscillator 17 which is designed to produce a negative going spike at its output 18 in the case where the Q output 13 has been continuously high for a predetermined number of the predetermined time periods. In other words, in order for the UJT oscillator 17 to produce a negative going spike on output 18, the sensor 10 must output a series of pulses on line 11 so as to maintain the monostable multivibrator 12 latched in its unstable state for a predetermined number of its unstable time durations. The series of pulses, of course, corresponds to continuous, or at least semi-continuous, movement of repetitious nature, of the item being protected.

Therefore, if continuous movement for a sufficient length of time occurs, a negative going spike will be applied from the output 18 of the UJT oscillator 17 to the second input 19 of the NOR gate 16. In association with the logically low level signal being applied to input 15 of NOR gate 16 from the $\overline{Q}$ output 14, the negative going spike applied to the input 19 will cause the NOR gate 16 to output over line 20 a logically high level signal to the firing circuit 21. In turn, the firing circuit 21 will activate a series of alarms 22 by developing an appropriate signal on line 23. In addition, an alarm such as at 24 may be included which will activate whenever the Q output 13 of the monostable multivibrator 12 is logically high. It will thus be appreciated that whereas alarm 24 will be activated whenever the Q output 13 is logically high, the alarm 22 will be activated only when the Q output 13 has been logically high for a predetermined number of the unstable time durations of the monostable multivibrator 12. In this manner, the more drastic alarm functions, which comprise alarm 22, are activated only after continuous motion for some predetermined period of time has been detected. On the other hand, a less obtrusive alarm function at alarm 24 will be activated immediately upon the detection of any movement sufficient to trigger sensor 10.

Figure 3:
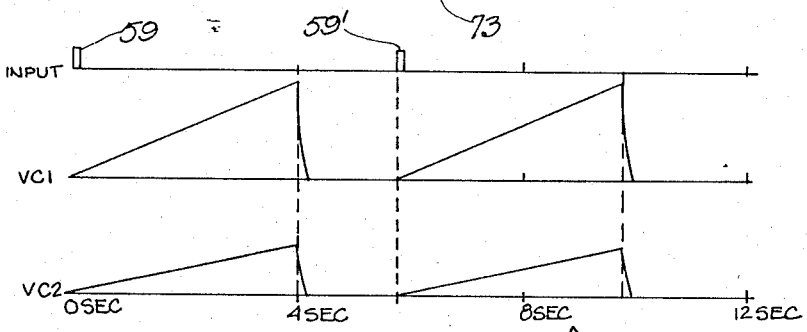
FIGS. 3*a* and 3*b* include graphical representations of the waveforms of signals at various locations in the schematic diagram of FIG. 2 under two different conditions.
Figure 3:
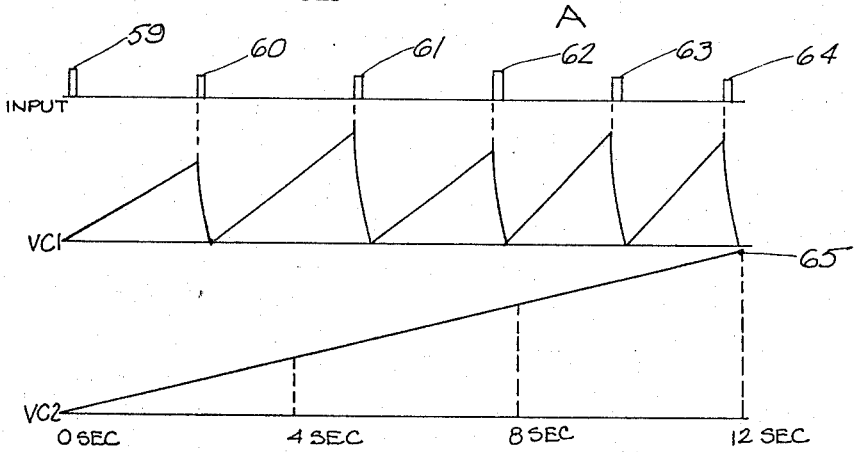
Figure 2:
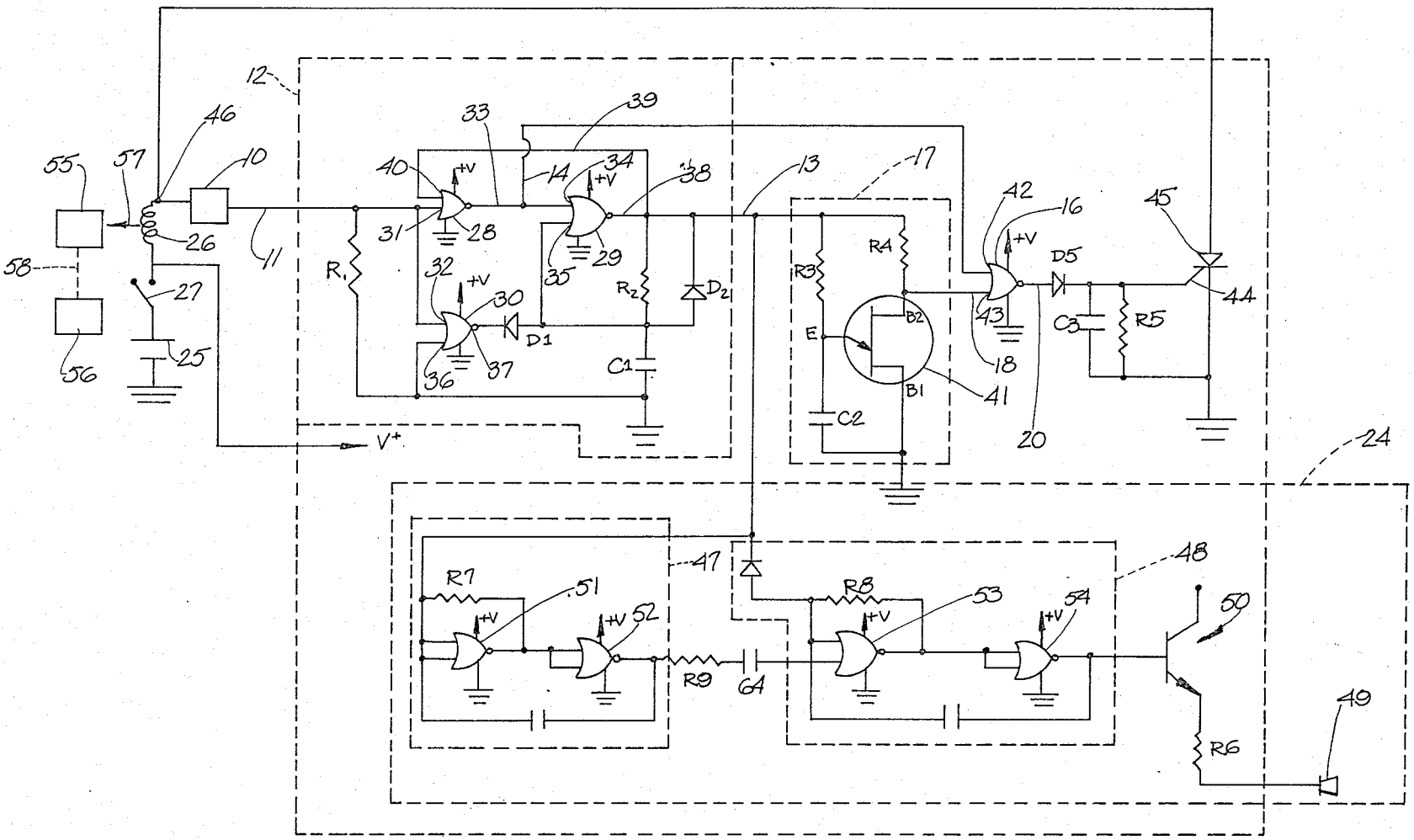
FIG. 2 is a schematic diagram corresponding to the preferred embodiment of the present invention shown in block form in FIG. 1.

A better understanding of the circuit operation of the alarm system of the present invention will be had from the following description of FIGS. 2 and 3. FIG. 2 is a schematic circuit diagram according to FIG. 1 and FIG. 3 shows waveshapes at various points in FIG. 2 under two different conditions.

The sensor 10 is connected between the monostable multivibrator 12 by line 11 and a source of potential 25 through an electric squib element 26 and a key switch 27. Squib element 26 may be an electronic match assembly manufactured by Atlas Powder Company, Wilmington, Del. The monostable multivibrator 12 comprises three NOR gates 28, 29 and 30, each of which has a ground connection and a connection to the potential +V derived from the potential source 25. The output 11 of the sensor array 10 connects to one input 31 of the NOR gate 28, to one input 32 of NOR gate 30 and to ground by means of resistor R1. The second input 36 of NOR gate 30 is connected to ground. The output 33 of NOR gate 28, which comprises the $\overline{Q}$ output 14 of the monostable multivibrator 12, connects to one input 34 of NOR gate 29. The second input 35 of NOR gate 29 is connected to the junction formed by the anodes of diode D1 and D2, one end of resistor R2 and one plate of capacitor C1. The cathode of diode D1 is connected to the output 37 of NOR gate 30, the cathode of diode D2 and the remaining end of resistor R2 to the output 38 of NOR gate 29, which comprises the Q output 13 of the monostable multivibrator 12, and the remaining plate of capacitor C1 connects to ground. Finally, a feedback path 39 is provided between the output 38 of NOR gate 29 and the second input 40 of NOR gate 28.

UJT relaxation oscillator 17 is of standard configuration and utilizes as its supply voltage the Q output 13. The oscillator 17 includes a unijunction transistor 41, a pair of resistors R3 and R4 connected between, respectively, the Q output 13 and the emitter E and second base B2 of the UJT 41. Also, the emitter E of the UJT 41 is connected to ground through capacitor C2 and the first base B1 is connected directly to ground.

NOR gate 16, which has at its first input 42 the $\overline{Q}$ output 14 and at its second input 43 the output 18 from the second base B2 of UJT 41, is connected through diode D5 and a wave shaping circuit comprising the parallel combination of capacitor C3 and resistor R5 to the gate 44 of the silicon controlled rectifier (SCR) 45. The cathode of SCR 45 is connected to the ground while its anode is connected to the junction 46 between the electronic match 26 and the sensor array 10.

The Q output 13 of the monostable multivibrator 12 is also connected to an alarm 24 which, as shown in FIG. 2, comprise a pair of oscillators 47 and 48 connected to a speaker 49 through an amplifier 50 and a current limiting resistor R6. In the case of both oscillator 47 and 48, each of which comprises a pair of NOR gate 51, 52 and 53, 54, oscillation is achieved through the use of feedback resistors R7 and R8. In the preferred embodiment of the present invention, the component values of oscillators 47 and 48 are chosen so as to render oscillator 47 operable at a few cycles per second and oscillator 48 operable at approximately 800 cycles per second. A differentiating circuit comprising resistor R9 and capacitor C4 is connected between the oscillators 47 and 48 whereby the output at the speaker 49 is an 800 cycle per second signal frequency modulated by a three cycle per second signal.

Finally, diagrammatically represented by blocks 55 and 56 are a pair of electronic match activatable alarm functions. For example, alarm function 55 may comprise one of several types of pyrotechnic whistles, which are well known in the fireworks industry, whereas alarm function 56 may comprise a smoke charge. In either event, activation of the alarm function 55, 56 is controlled by the firing of the electronic match 26. As represented by arrow 57 the pyrotechnic whistle 55 is directly associated with the electronic match 26 and activates concurrently with the firing thereof. A fuse 58 extends from whistle 55 and connects to the smoke charge 56 whereby activation of smoke charge 56 is achieved in response to activation of whistle 55 and after a delay corresponding to the length of fuse 58.

Operation of the circuitry shown in FIG. 2 is most conveniently explained with reference to the charts shown in FIG. 3. Initially, in its pre-activated condition, i.e. with no output from the sensor array 10 indicating that the item being protected is motionless, the input at terminals 40, 31, 32 and 36 of NOR gates 28 and 30 are all logically low. Thus, the outputs 33, 37 of NOR gates 28, 30 are logically high and the output 38 of NOR gate 29 is logically low. The logically high level signal at output 33 of NOR gate 28, the $\bar{Q}$ output of the monostable multivibrator 12, is applied to input 42 of NOR gate 16 thereby rendering the output 20 of NOR gate 16 logically low so as to prevent a signal from being applied to the gate 44 of the SCR 45. And, the logically low level signal at output 38 of NOR gate 29, the Q output 13 of the monostable multivibrator 12, is applied to the oscillators 47 and 48 loading the oscillators and thereby preventing them from running.

When a first pulse 59 from the sensor, indicating that motion has been imparted to the item being monitored, is output on line 11, input 31 and 32 of NOR gates 28 and 30 go logically high. Consequently, the output 33 of NOR gate 28 goes logically low and the output 38, 13 of NOR gate 29 goes logically high. The logically high output at 38 is fed back to input 40 of NOR gate 28 to maintain the output of NOR gate 28 logically low and the output of NOR gate 29 logically high. It will be noted that whereas output 33 of NOR gate 28 is latched at a logically low level in response to pulse 59, (i.e., it remains at this level even though pulse 59 has transpired) thereby maintaining output 38 of NOR gate 29 at a logically high level, output 37 of NOR gate 30 reverts to a logically high level immediately after the occurrence of pulse 59.

As a result of the logically high level signal at output 38 of NOR gate 29, capacitor C1 begins charging through resistor R2 (note the VC1 waveforms in FIGS. 3*a* and 3*b*) and capacitor C2 of oscillator 17 begins charging through resistor R3 (note the VC2 waveforms in FIGS. 3*a* and 3*b*). In the preferred embodiment of the present invention, capacitor C1 will charge to a logically high state in approximately four seconds. Thus, if no further pulses are received from the sensor array 10 during four second interval, the output 38 of NOR gate 29 will go logically low whereby capacitor C1 will discharge through diode D2 and the ground connection of NOR gate 29 and capacitor C2 will discharge through resistor R3 and the ground connection of NOR gate 29. The charging of capacitors C1 and C2 after the occurrence of pulse 59 is facilitated by the logically high level at output 37 of NOR gate 30 which maintain diode D1 reverse biased. After discharging capacitor C1 and C2, the circuit is re-initialized and continues to monitor the output of the sensor array 10.

During the above described sequence, the voltage across capacitor C2 failed to reach a level sufficient to forward bias the emitter E of UJT 41 and therefore the SCR 45 remains off. In the preferred embodiment, circuit components have been chosen so that the Q output 13 must remain logically high for approximately 12 seconds before capacitor C2 attains a sufficient charge to forward bias the emitter E of UJT 41. When this occurs, the output 20 of NOR gate 16 goes high, activating SCR 45, the electronic match 26 and the alarm functions 55, 56. FIG. 3*b* shows a condition wherein the circuit of FIG. 2 activates the alarm functions 55, 56.

In FIG. 3*b*, it will be noted that the pulse 59 causes capacitors C1 and C2 to begin charging in a manner identical to that shown in FIG. 3*a*. However, in FIG. 3*b* a further pulse 60 is generated by the sensor array 10 before the four second interval is completed. Pulse 60 will cause output 37 of NOR gate 30 to go low for a brief period of time sufficient to allow capacitor C1 to discharge through diode D1 and the ground circuit of NOR gate 30. Since capacitor C1 has discharged before VC1 has reached a logically high state, output 38 of NOR gate 29 remains logically high and capacitor C2 continues charging. Simultaneously, capacitor C1 begins recharging through resistor R2 in a manner as previously described. If further pulses such as 61, 62, 63 and 64 are generated by the sensor array 10, the voltage across capacitor C2 will eventually forward bias the emitter E of UJT 41. This is shown by point 65 in FIG. 3*b*. At point 65 UJT 41 begins to conduct and a negative going spike is applied from its second base B2 to input 43 of NOR gate 16 which results in a logically high signal at its output 20. The logically high signal at output 20 is applied through diode D5 and the wave shaping circuit comprising capacitor C3 and R5 to the gate 44 of the SCR 45. SCR 45 will thereby be rendered conductive and cause electronic match means 26 to ignite. In turn, alarm function 55, a pyrotechnic whistle or the like, will activate followed by the delayed activation of alarm function 56 which may comprise a smoke charge or the like.

As described above, a series of pulses from the sensor array 10 such as shown in FIG. 3*b* are required to activate alarm functions 55 and 56. It will be appreciated that a pulse sequence such as 59–64 indicates continuous movement for a length of time to which the system responds with the drastic alarms 55 and 56. On the other hand, in the case of slight momentary movement, such as indicated by the single pulse 59 in FIG. 3*a,* only the less obtrusive alarm 24 is activated for the four second period during which the Q output 13 is high. Thereafter, if a further pulse, such as pulse 59' in FIG. 3*a,* is generated by the sensor array 10, the charging sequences of capacitors C1, C2 will be reinitiated as shown by the waveforms VC1 and VC2 in FIG. 3*a.* If no further pulses are generated by the sensor array 10 or, if a pulse is generated beyond the four second interval, the circuit action described with respect to pulse 59 in FIG. 3*a* will be repeated for pulse 59'.

Figure 4:
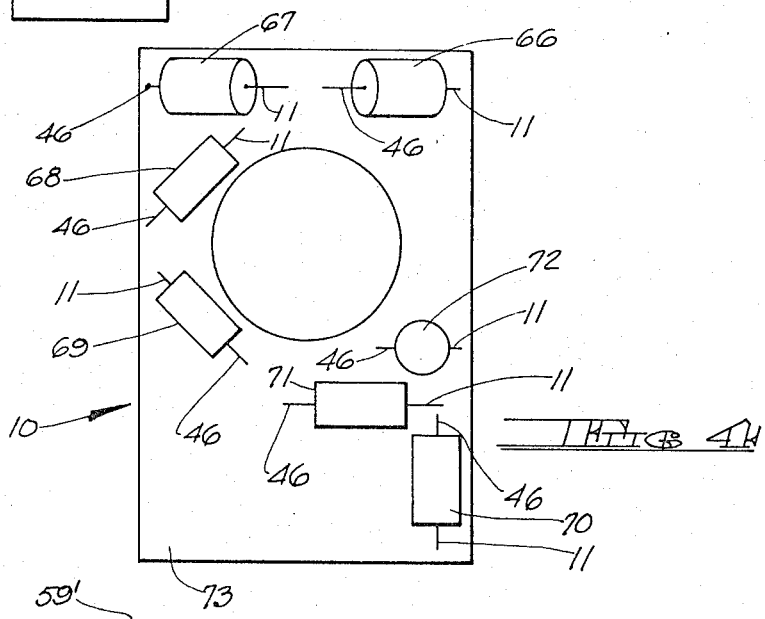
FIG. 4 is a plan view of the physical arrangement of the sensor array of the present invention.

A unique and particularly useful sensor array for use in association with the circuitry of FIG. 2 is shown in FIG. 4. The sensor array 10 comprises a plurality of mercury switches 66 through 72, all connected in parallel between line 11 and point 46. For structural purposes, the mercury switches 66 through 72 may all be fastened to a common substrate such as shown at 73. As will be noted from FIG. 4, the axes of mercury switches 68, 69, 70 and 71 lie in a plane parallel to the substrate 73 and are angularly disposed from each other by approximately 45°. Similarly, the axes of mercury switches 66, 67, 71 and 72 lie in planes perpendicular to the plane of the substrate 73 and are also disposed from each other by approximately 45°. Due to this arrangement of mercury switches, the sensor array is capable of detecting slight motional disturbances regardless of the direction of movement of substrate 73. That is, each switch 66 through 72 is particularly sensitive to movement in one direction and the totality of switches covers movement in all space in three dimensions. The mercury switches are of the single pole double throw type manufactured by Drakool, Inc., Elkhart, Ind. and operate such that contact is made only momentarily as mercury passes through the center of the switch. Due to a constriction in the tube of the switch, mercury cannot remain in a position to provide a continuously high output regardless of the orientation of the sensor array.

It is apparent from the foregoing that a new and improved alarm system has been provided. While only one presently preferred embodiment has been described herein, as will be apparent to those familiar with the art, certain changes and modifications can be made without departing from the scope of the invention. For example, it will be appreciated by those skilled in the art that although the preferred embodiment of the present invention has been described in terms of a monostable multivibrator 12 and a UJT oscillator 17 other well known means may be used in place thereof. Accordingly, it is within the scope of the present invention to utilize various other timing circuits in place of the monostable multivibrator 12 and UJT oscillator 17 described in detail herein.

The embodiments of the invention in which an exclusive property or privilege is claimed are defined as follows:

1. In an alarm system of the type for responding to motion, the improved combination comprising:

a. sensing means for detecting a motional disturbance and producing a pulsating signal in response thereto;

b. latch means connected for receiving said signal from said sensing means and having an output normally at a first logical level, said output of said latch means transitioning to a second logical level in response to the first pulse of said signal and remaining at said second logical level until said sensing means is characterized by the absence of said signal for a first predetermined time;

c. trigger means responsive to said output of said latch means for developing a trigger signal only after said output of said latch means has continuously been at said second logical level for a second predetermined time;

d. alarm means connected to said trigger means for generating an alarm signal in response to said trigger signal; and e. a source of potential.

2. An alarm system according to claim 1 wherein said trigger means and said latch means include means such that said second predetermined time is greater than said first predetermined time.

3. An alarm system according to claim 2 wherein said latch means comprises a resettable monostable multivibrator having a Q output comprising said output of said latch means and a $\overline{Q}$ output, the time duration of the unstable state of said multivibrator defining said first predetermined time.

4. An alarm system according to claim 3 wherein said trigger means comprises:

a. a UJT relaxation oscillator having as its supply voltage said Q output and wherein said second predetermined time is defined by the time during which the UJT of said oscillator is non-conducting when said Q output is at said second logical level; and b. a NOR gate having first and second inputs, said first input connecting to said $\overline{Q}$ output and said second input connecting to the second base of said UJT associated with said Q output, said NOR gate developing an output signal comprising said trigger signal when said UJT is driven into conduction.

5. An alarm system according to claim 1 including means in association with said latch means for producing an audible signal when said output of said latch means is at said second logical level.

6. An alarm system according to claim 1 wherein said alarm means comprises a SCR having a gate terminal connected for receiving said trigger signal, said SCR being rendered conductive in response to the application of said trigger signal to said gate terminal; an electric squib connected between one terminal of said SCR and the source of a potential, said electric squib firing in response to conduction by said SCR and at least one alarm function activatable in response to said firing of said electric squib.

7. An alarm system according to claim 6 wherein said at least one alarm function comprises a pyrotechnic whistle for activating concurrently with said firing of said electric squib and including a smoke charge having a fuse connected to said whistle, said smoke charge being activated in response to activation of said whistle after a time corresponding to the length of said fuse.

8. A sensor array for a motion responsive alarm comprising a first group of motion responsive sensors, the axes of each of which are parallel to a first plane and angularly disposed from each other and a second group of motion responsive sensors the axes of each of which are parallel to a second plane and angularly disposed from each other, said second plane being perpendicular to said first plane.

9. An alarm system according to claim 8 wherein said first and second groups of sensors comprise respectively first and second groups of mercury switches connected in parallel between the source of a potential and the input of said motion responsive alarm.

10. An alarm system according to claim 9 wherein said first group of switches comprises four switches whose axes are disposed from each other by substantially 45° and wherein said second group of switches comprises four switches whose axes are disposed from each other by substantially 45°.

* * * * *